US005961035A

United States Patent [19]

Correll

[11] Patent Number: 5,961,035

[45] Date of Patent: Oct. 5, 1999

[54] DESIGNER PIZZA BOX WITH ENHANCEMENTS

[76] Inventor: John D. Correll, 8459 Holly Dr., Canton, Mich. 48187

[ * ] Notice: This patent is subject to a terminal disclaimer.

[21] Appl. No.: 09/061,302

[22] Filed: Apr. 16, 1998

Related U.S. Application Data

[63] Continuation-in-part of application No. 08/731,586, Oct. 16, 1996, Pat. No. 5,833,130, and a continuation-in-part of application No. 08/589,892, Jan. 23, 1996, Pat. No. 5,806,755, which is a continuation-in-part of application No. 08/278,258, Jul. 21, 1994, Pat. No. 5,586,716.

[51] Int. Cl.[6] ..... B65D 5/20

[52] U.S. Cl. ..... 229/110; 229/104; 229/178; 229/906

[58] Field of Search ..... 229/104, 110, 229/152, 178, 902, 906

[56] References Cited

U.S. PATENT DOCUMENTS

| | | | |
|---|---|---|---|
| 1,649,088 | 11/1927 | Tinsley . | |
| 2,016,754 | 10/1935 | Perkit | 229/104 |
| 3,861,581 | 1/1975 | Sellors | 229/104 |
| 4,279,374 | 7/1981 | Webinger | 229/178 |
| 4,360,107 | 11/1982 | Roccaforte . | |
| 4,362,266 | 12/1982 | Webinger | 229/110 |
| 4,620,666 | 11/1986 | Lacasa et al. | 229/149 |
| 4,919,326 | 4/1990 | Deiger | 229/109 |
| 4,984,734 | 1/1991 | Zion et al. | 229/109 |
| 5,000,374 | 3/1991 | Deiger | 229/109 |
| 5,118,032 | 6/1992 | Gehd | 229/10 |
| 5,211,329 | 5/1993 | Patton | 229/110 |
| 5,402,930 | 4/1995 | Storms et al. | 229/125.28 |
| 5,429,296 | 7/1995 | Southwell et al. | 229/178 |
| 5,549,241 | 8/1996 | Correll | 229/120.01 |
| 5,586,716 | 12/1996 | Correll | 229/110 |
| 5,702,054 | 12/1997 | Philips et al. | 229/110 |
| 5,713,509 | 2/1998 | Correll | 229/152 |
| 5,806,755 | 9/1998 | Correll | 229/110 |
| 5,833,130 | 11/1998 | Correll | 229/104 |

FOREIGN PATENT DOCUMENTS

| | | | |
|---|---|---|---|
| 78570 | 12/1954 | Denmark | 229/110 |
| 2052443 | 1/1981 | United Kingdom | 229/110 |

*Primary Examiner*—Gary E. Elkins

[57] ABSTRACT

A designer-type pizza box employing one or more unique structural elements including: (a) at least six walls comprising front and rear walls, a pair of forward side walls, and a pair of non-parallel rearward side walls, with the length of the front wall being longer than the length of the rear wall; (b) an easy-folding rear diagonal side wall structure comprising a diagonally-disposed rearward side wall and a unitary plurality of hingedly connected connector panels extending between the rearward side wall and a rear wall; (c) a type of thermal-leg comprising a corner flap attached to the end of a wall and disposed between the panels of a double-panel wall and projecting through a hole in the bottom of the box; (d) a hole-covering double-panel wall structure comprising a hole-covering flap attached to the bottom edge of an inner panel of a double-panel wall and covering an opening in the bottom of the box; and (e) a strengthened double-panel wall comprising inner and outer panels joined by a double-panel connecting structure comprising first and second fold lines and a connector bridge of material between the fold lines, with the first and second fold lines being non-parallel.

30 Claims, 3 Drawing Sheets

DESIGNER PIZZA BOX WITH ENHANCEMENTS

CROSS-REFERENCES TO RELATED APPLICATIONS

This is a continuation-in-part application of my application Ser. No. 08/731,586, entitled "Multi-function Pizza Carton," filed Oct. 16, 1996, U.S. Pat. No. 5,833,130, and of my application Ser. No. 08/589,892, entitled "Product-protecting Pizza Carton," filed Jan. 23, 1996, U.S. Pat. No. 5,806,755, which is a continuation-in-part of my application Ser. No. 08/278,258, entitled "Designer-cover Box," filed Jul. 21, 1994, now U.S. Pat. No. 5,586,716.

FIELD OF THE INVENTION

This invention relates to boxes and blanks made of foldable material and, in particular, to cartons for relatively flat food products such as pizza and the like.

DESCRIPTION OF THE PRIOR ART

My application Ser. No. 08/278,258, entitled "Designer-cover Box," now U.S. Pat. No. 5,586,716, and my application Ser. No. 08/589,892, entitled "Product-protecting Pizza Carton," which is a continuation of application Ser. No. 08/278,258, each disclose a six-sided carton having a unique configuration of bottom panel and wall structure.

My application Ser. No. 08/731,586, entitled "Multi-function Pizza Carton," discloses a carton having a unique type of thermal-leg and a unique rear corner wall structure.

The invention disclosed herein is an improvement upon the aforementioned inventions and also, to an extent, a combination thereof. It is intended particularly for use in packaging pizza.

In the pizza industry, the following needs exist:

1) Need for a six-sided carton that has a distinctive shape, a relatively wide front wall panel, and is highly functional in a pizzeria operation;
2) Need for a carton that is easy-folding and easy-closing;
3) Need for a carton that provides reduced conducted heat loss through the bottom panel but that doesn't result in open holes in the bottom panel (which provide increased connective heat loss);
4) Need for a box that can be made of lightweight E-flute corrugated board but which has a rigid, non-bowing double-panel front wall.

Regarding need #1, there have been two approaches by the prior art to creating six-sided pizza cartons. The first approach involves a pair of parallel side walls adjacent a rear wall and a pair of diagonal walls adjacent the parallel side walls. This has resulted in a box having a front wall of narrower width than the box, or of narrower width than the rear wall. Examples of this approach include Patton U.S. Pat. No. 5,211,329 granted May 18, 1993, and Philips et al. U.S. Pat. No. 5,702,054 granted Dec. 30, 1997.

The second approach involves a first pair of diagonal walls adjacent a rear wall and second pair of diagonal walls adjacent the first pair. This has resulted in a box having front and rear walls of narrower width than the box and four diagonal walls all of equal length. Examples of this approach include Lacasa et al. U.S. Pat. No. 4,620,666 granted Nov. 4, 1986, and Geho U.S. Pat. No. 5,118,032 granted Jun. 2, 1992.

In both approaches, the prior art results in a carton having a front wall that is shorter than the width of the box, or shorter than the rear wall, and no square corners at the front of the box. This results in a "weak" appearance that some people might dislike, plus it leaves less space for writing directions on the front of the box. So there has remained a problem of how to have a box with at least six sides that also has a full-width front wall and a "strong" appearance. This problem has not been solved by the prior art but is solved by my invention. By solving this problem, a pizzeria can have the advantages of a box with at least six sides but without the drawbacks of the prior art boxes.

Regarding need #2, the need for a carton that's easy-folding and easy-closing, my invention addresses it with an improved rear diagonal side wall structure. This structure results in a linkage between the rear wall and a side wall of the box, whereby when one component moves the other moves, too. A version of this rear diagonal side wall structure was disclosed in my application Ser. No. 08/589,892, filed Jan. 23, 1996. The closest prior art to this invention are Deiger U.S. Pat. No. 4,919,326, granted Apr. 2, 1990, and Deiger U.S. Pat. No. 5,000,374 granted Mar. 19, 1991. However, in both cases, Deiger discloses a corner wall structure that is linked to the cover. This cover-linkage results in a box that is more difficult to fold and close.

Regarding need #3, the need for reducing conducted heat loss through the bottom of a box, my invention addresses it with a thermal-leg and a hole-covering flap. My application Ser. No. 08/731,586 discloses two types of thermal-legs; this invention discloses a third type. There is no prior art on thermal-legs, per se. The closest structure is Zion et al. U.S. Pat. No. 4,984,734 granted Jan. 15, 1991; Storms et al. U.S. Pat. No. 5,402,930 granted Apr. 4, 1995; and Correll U.S. Pat. No. 5,549,241 granted Aug. 27, 1996.

In creating certain types of thermal-legs it can result in an opening, or hole, in the bottom of the box. This is undesirable because it can result in increased convective air flow into and out of the box, resulting in pizza temperature loss. To counteract that, I disclose a hole-covering double-panel wall structure. None of the prior art discloses such an invention. The closest prior art is Roccaforte U.S. Pat. No. 4,360,107 granted Nov. 23, 1982, and Tinsley U.S. Pat. No. 1,649,088 granted Nov. 15, 1927.

Regarding need #4, the need for a rigid, non-bowing double-panel wall, my invention addresses the problem by providing for a uniquely-shaped connector bridge of material between the panels of the double-panel wall. This connector bridge can be wider in the middle than on the ends, a condition created by two non-parallel fold lines. The use of two non-parallel fold lines in a double-panel wall structure was first disclosed in my application Ser. No. 08/731,586, filed Oct. 16, 1996. The need for more rigid double-panel walls has arisen from the trend toward using lighter-weight E-flute board in making pizza boxes. Lighter, thinner board has resulted in an outward bowing of the double-panel front wall. My invention strengthens the wall and removes the bowing. The prior art shows a double-panel wall with two parallel fold lines but none shows non-parallel lines.

In conclusion, it would be highly desirable to provide a box that overcomes the above-described problems and disadvantages and, thereby, satisfies the above needs.

OBJECT AND ADVANTAGES

Accordingly, the object of my invention is a box that provides opportunity to do one or more of the following:

1) Have a six-sided pizza box with a unique appearance and enhanced functionality compared to current six-sided boxes;

2) Have a six-sided pizza box with square corners in the front;
3) Have a six-sided pizza box with a full-width front wall, or a front wall that is wider than a rear wall;
4) Have a pizza box with a rear diagonal side wall structure that allows for easy box-folding and closing;
5) Have a pizza box with one or more thermal-legs to provide reduced conducted heat loss through the bottom panel of the box but that doesn't result in increased convective heat loss from open holes in the bottom panel;
6) Have a pizza box that has a rigid, non-bowing double-panel front wall even when it's made of thin, light-weight E-flute board.

The advantages of my invention are one or more of the following: (a) unique-looking six-sided box that distinguishes a pizzeria from the competition, (b) six-sided box with square corners in the front for packing a sauce cup and with a full-width or relatively wide front wall for writing directions, (c) ease in box-folding and closing, (d) better heat retention and greater customer satisfaction, and (e) a nicer-looking E-flute box that has a rigid, non-bowing double-panel front wall.

Further objects and advantages of the invention will become apparent from consideration of the following detailed description, related drawings, and appended claims.

SUMMARY OF THE INVENTION

My invention is a box and associated blank that incorporates one or more of the following structural features:

1) A unique structure comprising at least six walls including opposing front and rear walls, a pair of forward side walls adjacent the front wall, and a pair of non-parallel rearward side walls adjacent the forward side walls, with the walls being of such angle and structure that the length of the front wall is longer than the length of the rear wall (a structure previously disclosed in my application Ser. No. 08/589,892 and my application Ser. No. 08/278,258, now U.S. Pat. No. 5,586,716);
2) An easy-folding rear diagonal side wall structure comprising a diagonally-disposed rearward side wall attached to a rear end of a forward side wall and with a unitary plurality of hingedly connected connector panels attached to a bottom edge of the rearward side wall and to an end edge of a rear wall without being attached to the cover of the box (previously disclosed in my application Ser. No. 08/589,892);
3) A thermal-leg resulting from a corner flap attached to the end of a wall and disposed between the panels of a double-panel wall and projecting through a hole in the bottom of a box;
4) A hole-covering double-panel wall structure comprising a hole-covering flap attached to the bottom edge of an inner panel of a double-panel wall and covering an opening in the bottom of a box, particularly an opening resulting from the creation of a thermal-leg;
5) An extra-rigid double-panel wall comprising inner and outer panels joined by a double-panel connecting structure comprising first and second fold lines and a connector bridge of material between the fold lines, with the first and second fold lines being non-parallel, thereby allowing the connector bridge to be wider at one spot than another (previously disclosed in my application Ser. No. 08/731,586).

My invention typically would be used for packaging relatively flat food products such as pizza; however, it could be used for other purposes, as well.

A complete understanding of the invention can be obtained from the detailed description that follows.

LIST OF REFERENCE NUMERALS

Figure 1:
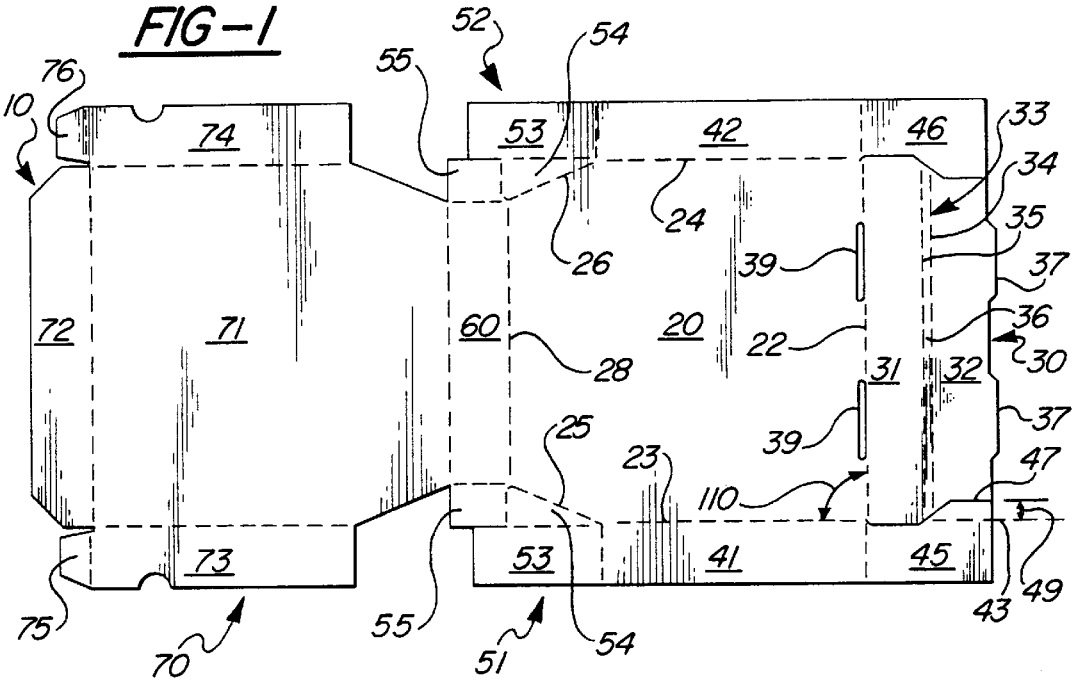
FIG. 1 is a plan view of a blank of the first preferred embodiment of the invention.

Within a drawing, closely related figures may have the same number. Between drawings, like reference numerals designate corresponding parts.

| | |
|---|---|
| 10 | blank of first embodiment |
| 12 | box of first embodiment |
| 14 | blank of second embodiment |
| 16 | box of second embodiment |
| 20 | bottom panel |
| 22 | front edge |
| 23 | first forward side edge (and bottom edge of first forward side wall) |
| 24 | second forward side edge (and bottom edge of second forward side wall) |
| 25 | first rearward side edge |
| 26 | second rearward side edge |
| 28 | rear edge |
| 30 | double-panel front wall structure |
| 31 | outer panel |
| 32 | inner panel |
| 33 | double-panel connecting structure |
| 34 | first fold line |
| 35 | second fold line |
| 36 | connector bridge of material |
| 37 | interlock tab |
| 39 | double-panel interlock opening |
| 41 | first forward side wall |
| 42 | second forward side wall |
| 43 | bottom edge extension line |
| 44 | flap |
| 45 | corner flap |
| 46 | corner flap |
| 47 | flap bottom edge (and bottom edge of thermal-leg) |
| 49 | predetermined distance |
| 51 | first rearward side wall structure |
| 52 | second rearward side wall structure |
| 53 | rearward side wall |
| 54 | first connector panel |
| 55 | second connector panel |
| 60 | rear wall |
| 70 | cover |
| 71 | cover panel |
| 72 | front flap |
| 73 | first side flap |
| 74 | second side flap |
| 75 | first front wall interlock flap |
| 76 | second front wall interlock flap |
| 81 | outer panel |
| 82 | inner panel |
| 83 | flap |
| 84 | hole-covering flap |
| 85 | thermal-leg |
| 86 | lower portion of bottom edge (and inner edge of irregular-shaped opening) |

-continued

| | |
|---|---|
| 87 | upper portion of bottom edge (and outer edge of irregular-shaped opening) |
| 88 | interlock tab |
| 89 | interior opening |
| 92 | length of front edge |
| 93 | length of forward side edge |
| 95 | length of rearward side edge |
| 98 | length of rear edge |
| 102 | length of front wall |
| 103 | length of forward side wall |
| 105 | length of rearward side wall (first embodiment) |
| 106 | length of rearward side wall (second embodiment) |
| 108 | length of rear wall |
| 110 | angle |
| 120 | predetermined distance |

DESCRIPTION OF THE PREFERRED EMBODIMENTS

Referring now to the drawings, there is illustrated two preferred embodiments of the invention in blanks made of corrugated paperboard and, correspondingly, boxes created from the blanks. The intended use for the embodiments is as hot food cartons or, specifically, pizza boxes. However, it will be appreciated, as the description proceeds, that my invention may be realized in other embodiments and may be used in other applications.

Figure 2:
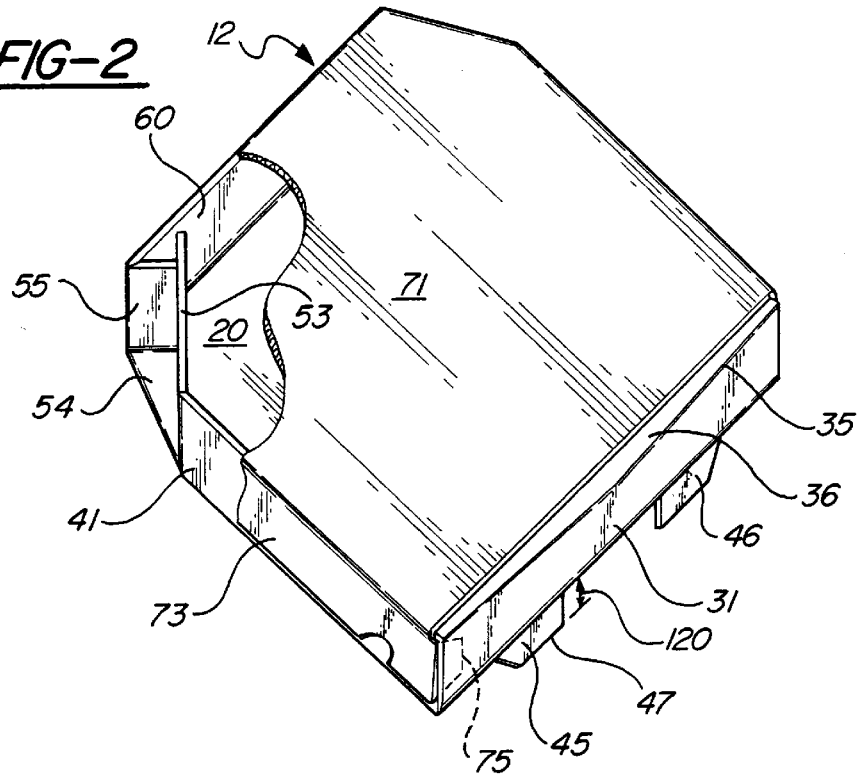
FIG. 2 is a perspective view of a box formed from the blank of the first embodiment.
Figure 3:
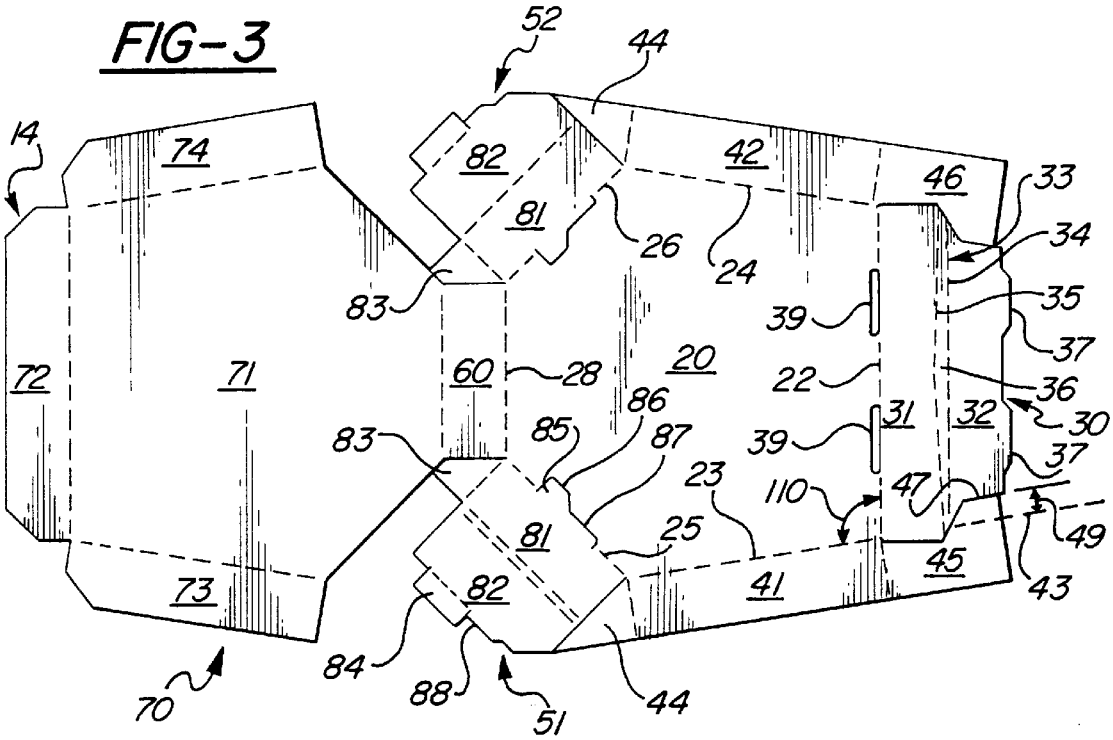
FIG. 3 is a plan view of a blank of the second preferred embodiment of the invention.
Figure 4:
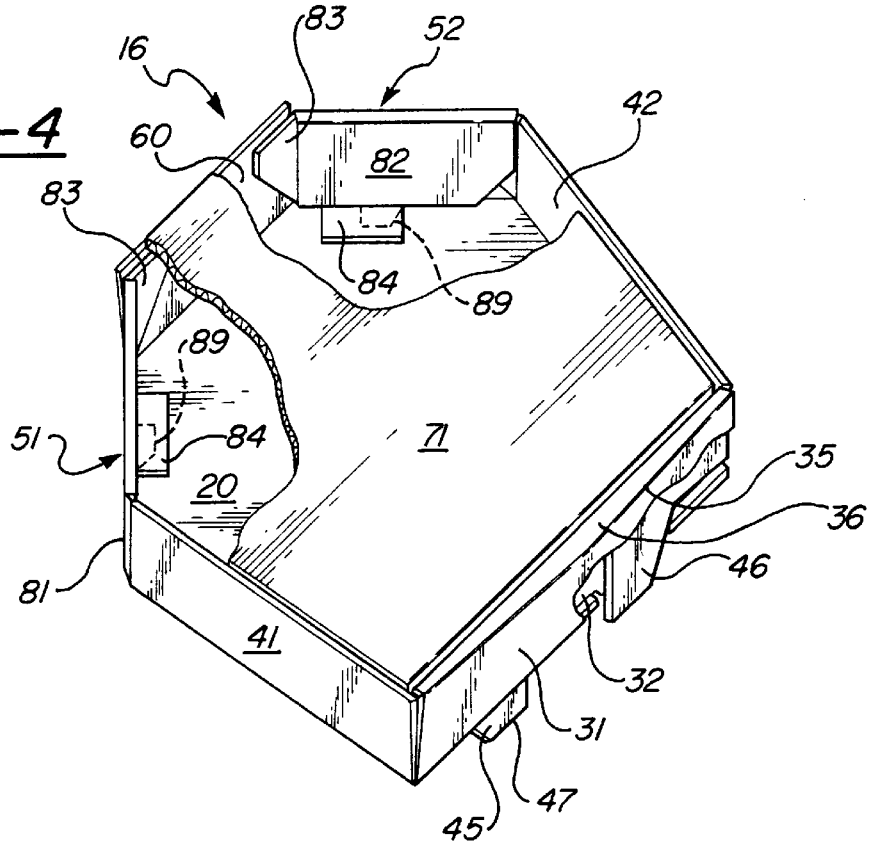
FIG. 4 is a perspective view of a box formed from the blank of the second embodiment.

FIGS. 1 and 2 show blank 10 and box 12, respectively, of the first embodiment. FIGS. 3 and 4 show blank 14 and box 16, respectively, of the second embodiment. The following discussion pertains to both embodiments except where noted when something applies to one embodiment only. Corresponding parts between embodiments and between drawings share a same reference numeral.

Structure of the Invention

Referring now to FIGS. 1 through 4, there is a bottom panel 20 which has a front edge 22, first and second forward side edges 23 and 24, respectively, non-parallel first and second rearward side edges 25 and 26, respectively, and a rear edge 28. It is noted that forward side edges 23, 24 are adjacent front edge 22 and rearward side edges 25, 26 are adjacent the forward side edges. In the first embodiment (FIGS. 1, 2), edges 23, 24 are parallel; in the second embodiment (FIGS. 3, 4), they're non-parallel. In both embodiments, edges 25, 26 are non-parallel.

Forward side edges 23, 24 are disposed at an angle 110 to front edge 22. In the first embodiment, angle 110 is a perpendicular angle; in the second embodiment, it's a non-perpendicular angle and, specifically, an obtuse angle. In both embodiments, angle 110 is a non-acute angle.

Figure 5:
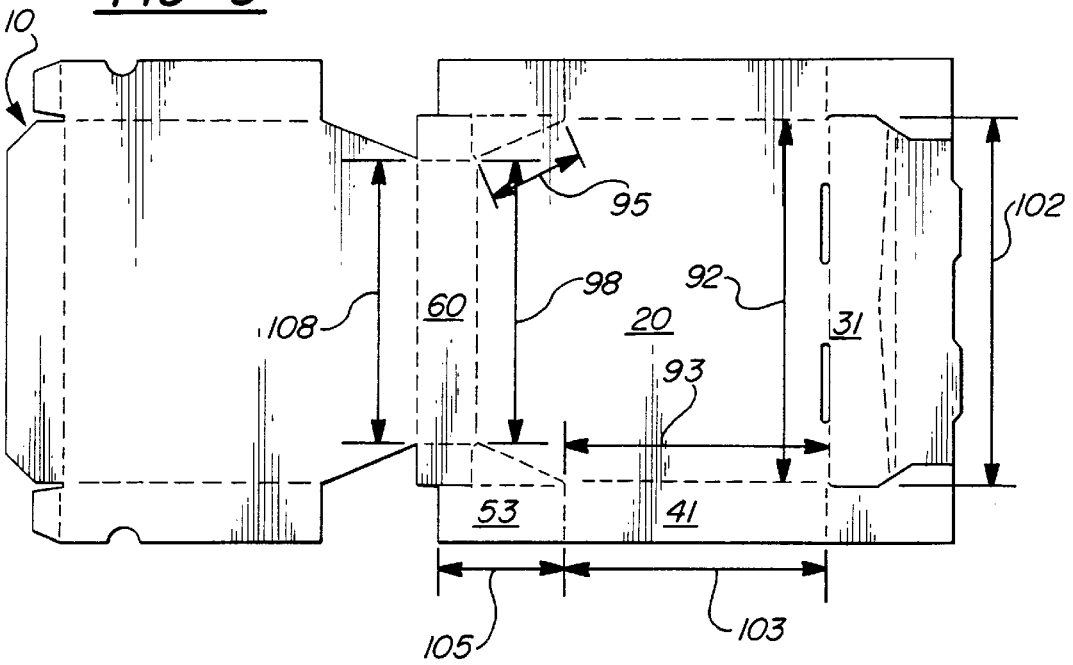
FIG. 5 is a plan view of the blank of the first embodiment showing dimensions.
Figure 6:
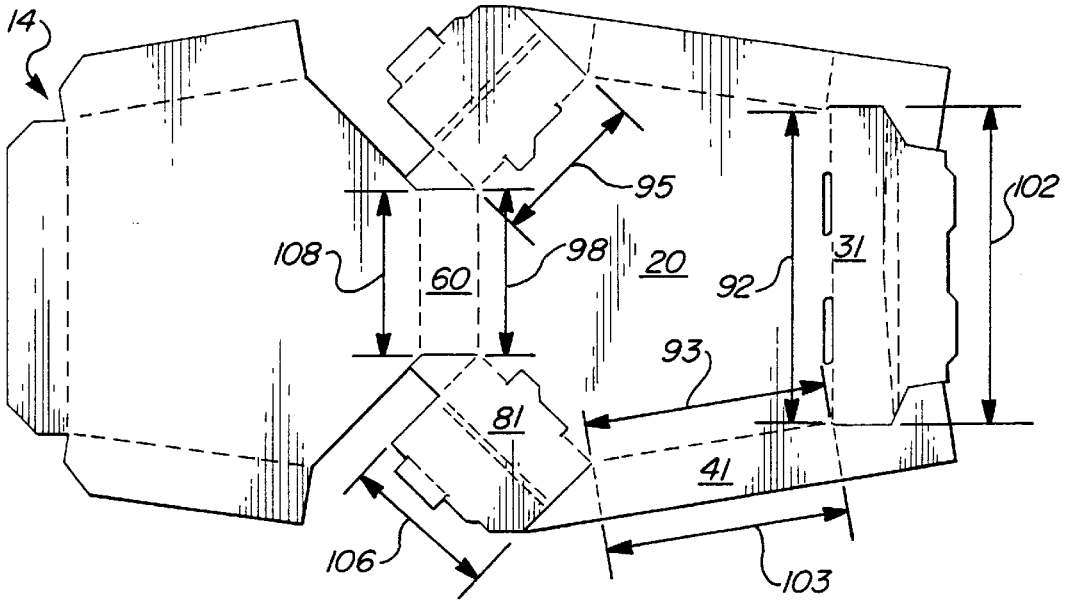
FIG. 6 is a plan view of the blank of the second embodiment showing dimensions.

The structure, or relationship between the edges, of bottom panel 20 is a key part of my invention. Referring to FIGS. 5 and 6, front edge 22 has a length 92, first and second forward side edges 23 and 24 each have a length 93, first and second rearward side edges 25 and 26 each have a length 95, and rear edge 28 has a length 98.

Regarding those lengths, the following unique structural configurations are noted. First, length 92 is noticeably longer than length 98 and, specifically, is at least 10 percent longer. Second, there is a noticeable difference in length between lengths 93 and 95. In particular, that difference amounts to at least 10 percent of the length of either of lengths 93 and 95. Third, length 93 is noticeably longer than length 95 and, specifically, is at least 20 percent longer. Finally, in the case of blank 14, it is noted that the second structural configuration occurs in combination with both the forward side edges 23, 24 being non-parallel and the rearward side edges 25, 26 being non-parallel.

A double-panel front wall structure 30 comprises an outer panel 31 attached to edge 22 and an inner panel 32 attached to panel 31. Panels 31 and 32 are joined by a double-panel connecting structure 33 that comprises first and second fold lines 34 and 35, respectively, and a connector bridge of material 36 between the fold lines. Fold lines 34 and 35 are non-parallel to each other and are of such configuration that they are farther apart at the middle than at the ends. This results in connector bridge 36 being wider at a middle spot than at end spots. (A prior disclosure of non-parallel fold lines in a double-panel wall structure is made in my application Ser. No. 08/731,586.)

This configuration of connector bridge 36 adds rigidity to the middle portion of double-panel wall structure 30 when it's in the box format. As a result, when the box is made of lightweight E-flute board, which is prone to bowing, this configuration adds rigidity to the double-panel wall and, thereby, prevents it from excessively bowing outward.

To retain inner panel 32 in an upright position in the box format, the panel has two interlock tabs 37 that engage with double-panel interlock openings 39 which are disposed in the bottom of the box. In the embodiments, an opening 39 is created in the blank by a slot-shaped hole; however, it could also be created in the blank by a U-shaped slot-forming slit that converts into a slot-shaped hole when the blank is erected into a box.

First and second forward side walls 41 and 42, respectively, are hingedly attached to edges 23 and 24, respectively. As such, the reference numerals "23" and "24" also indicate the bottom edge of side walls 41 and 42. A bottom edge extension line 43, which is an imaginary extension of the bottom edge of wall 41, extends forward from edge 23.

Corner flaps 45 and 46 are attached to a front end of walls 41 and 42, respectively. Flap 45 has a flap bottom edge 47 which extends below extension line 43 by a predetermined distance 49, resulting in a downward-projecting portion to the flap. In the box format (FIGS. 2 and 4), flap 45 is disposed between inner and outer panels 31 and 32 and the downward-projecting portion extends through opening 39.

The disposition of bottom edge 47 below extension line 43 enables corner flap 45 to provide a thermal-leg (on boxes 12 and 16, the thermal-leg is indicated by numeral 45). In the box format, edge 47 is the bottom edge of the thermal-leg. Edge 47 is disposed below bottom panel 20 by a predetermined distance 120 (shown in FIG. 2).

Although not labeled in the drawings, a similar structural arrangement applies to wall 42 and flap 46.

The purpose of a thermal-leg is to hold the bottom panel of a hot food carton far enough above a support surface, such as a table, to eliminate heat conduction through the bottom panel and into the support surface. To compensate for downward warping of the bottom panel of a hot food carton, it's recommended that distance 49 be at least ten millimeters. Correspondingly, it's recommended that distance 120 (which is the height of the thermal-leg projecting downward from the bottom of the box) be at least eight millimeters. (A prior disclosure and discussion of thermal-leg structure and operation is found in my application Ser. No. 08/731,586.)

A carton can be configured to have thermal-legs along two opposing edges, as in the second embodiment, or can be configured to have thermal-legs along one edge only, as in the first embodiment which has them on the front edge exclusively. An advantage of having thermal-legs along one edge only is that it can make for easier box stacking. In the case of the first embodiment, when stacking boxes hang the thermal-legs of the upper box over the front edge of the box beneath it.

Moving on, each of the embodiments has first and second rearward side wall structures 51 and 52, respectively, attached to rearward side edges 25 and 26, respectively. However, the structures differ between embodiments.

In the first embodiment (FIGS. 1, 2), structure 51 comprises a rearward side wall 53 hingedly attached to a rear end of forward side wall 41. A first connector panel 54 is attached to a bottom edge of wall 53 and to edge 25. A second connector panel 55 is attached to panel 54 and to a rear wall 60. It is noted that panels 54 and 55 constitute a unitary plurality of hingedly connected connector panels which are hingedly attached to side wall 53 and to rear wall 60. It is further noted that the plurality of connector panels does not attach to cover panel 70 or to any other component of the blank or box. This type of rearward side wall structure allows for easy box folding and closing because it links the side wall with the rear wall but doesn't engage the connecting panels with the cover (contrary to how it's done in Deiger U.S. Pat. Nos. 4,919,326 and 5,000,374).

Structure 52 is the same as structure 51.

In the second embodiment (FIGS. 3, 4), structure 51 is a double-panel wall structure comprising an outer panel 81 attached to edge 25 and an inner panel 82 hingedly linked by parallel fold lines to a top edge of panel 81. A flap 83 is attached to a rear end of panel 81 and a hole-covering flap 84 is attached to a bottom edge of panel 82.

A thermal-leg 85 projects from a bottom edge of panel 81. The thermal-leg has a bottom edge having a lower portion 86 and an upper portion 87. When blank 14 is erected into box 16, thermal-leg 85 moves to perpendicular position in relation to bottom panel 20, resulting in an irregular-shaped opening in the bottom of the box. The opening has inner and outer edges which correspond with lower and upper portions 86, 87 of the bottom edge of thermal-leg 85. As such, reference numerals "86" and "87" also indicate inner and outer edges, respectively, of the irregular-shaped opening.

In the box format, an interlock tab 88 on the bottom edge of inner panel 82 projects into the irregular-shaped opening and is held in place by engagement with outer edge 87.

With panel 82 erected in vertical position, an interior opening 89 is formed in the bottom of the box. To minimize air flow into and out of the box cavity, opening 89 is covered by hole-covering flap 84, which is disposed approximately perpendicular to panel 82. The attachment of flap 84 to inner panel 82 makes the entire wall structure a "hole-covering double-panel wall structure."

Also, a flap 44, which is attached to a rear end of wall 41, is disposed between panels 81 and 82 in the box format.

Structure 52 is the same as structure 51.

As with the edges of bottom panel 20, there is a unique structural relationship between the walls of boxes 12 and 16.

First, it is noted that structures 51 and 52 result in first and second rearward side walls which are disposed non-parallel to each other.

Second, the relationship between the lengths of the walls is a key part of my invention. Referring to FIGS. 5 and 6, front wall structure 30 has a length 102, first and second forward side walls 41 and 42 each have a length 103, first and second rearward side walls 53 (of the first embodiment) each have a length 105, first and second rearward side walls 81 (of the second embodiment) each have a length 106, and rear wall 60 has a length 108.

Regarding those lengths, the following unique structural configurations are noted. First, length 102 is noticeably longer than length 108 and, specifically, is at least 10 percent longer. Second, there is a noticeable difference in length between lengths 103 and 105/106. In particular, that difference amounts to at least 10 percent of the length of either of lengths 103 and 105/106. Third, length 103 is noticeably longer than length 105 or 106 and, specifically, is at least 20 percent longer. Finally, in the case of box 16, it is noted that the second structural configuration occurs in combination with both the forward side walls being non-parallel and the rearward side walls being non-parallel.

In both embodiments, a cover 70 is attached to rear wall 60. Cover 70 comprises a cover panel 71, a front flap 72, and first and second side flaps 73 and 74, respectively, which are attached to opposing sides of panel 71. In the first embodiment, there is also a front wall interlock means, which is shown in the form of first and second front wall interlock flaps 75 and 76, respectively, attached to a front end of flaps 73 and 74, respectively.

In the box format of the first embodiment, flaps 73 and 74 are disposed on the exterior side of walls 41 and 42 and flaps 75 and 76 are disposed between panels 31 and 32 of the front wall structure, thereby interlocking cover 70 with the front wall.

In the box format of the second embodiment, flaps 72, 73, and 74 are all disposed inside the box cavity. However, front wall interlock flaps could be added to the second embodiment to achieve the same type of cover interlock arrangement as with the first embodiment.

Within the context of this invention, a fold line can be created by a number of means such as, for example, by a crease or score in the board, by a series of aligned spaced short slits in the board, and by a combination of aligned spaced short and long slits. In some cases, when a longer slit is bounded on the ends by a series of shorter slits or a score, the longer slit may be slightly offset in alignment from the shorter slits or score for the purpose of creating a slot along the fold line when the blank is set up into a box. Such an offset slit may be referred to herein as a "slot-forming slit." Nonetheless, the entire combination of long and short slits is considered to constitute a single fold line unless otherwise indicated.

In addition, to create a fold line where one panel is folded 180° to lay parallel on another panel, the fold line may constitute two narrowly-spaced parallel scores or series of aligned slits. In this case, the two narrowly-spaced parallel scores or series of aligned slits constitute a single fold line unless otherwise indicated. The type of fold lines shown in the drawings are presently preferred but it will be appreciated that other methods known to those skilled in the art may be used.

Operation of the Invention

To erect the blank of the first embodiment into a box, the following procedure is recommended. First, fold corner flaps 45, 46 inward while folding side walls 41, 42 to upright position. Second, fold outer panel 31 to upright position and fold inner panel 32 downward, thereby erecting the front wall of the box and locking corner flaps 45, 46 into position so that the bottom portion of the flaps extends through openings 39 in the bottom of the box. Third, push side walls 53 inward, causing them to "flip" into diagonal position. Fourth, pull cover 70 forward while folding cover front flap 72 inward so that it fits inside the box cavity. Fifth, after the cover is closed on the box, push interlock flaps 75, 76 downward and then fold side flaps 73, 74 downward while guiding flaps 75, 76 into the front corners of the box (between panel 31 and cover flaps 45, 46).

It is noted that as side walls 53 move to the inward position rear wall 60 automatically moves forward. This is caused by the plurality of connector panels (54,55) that link the side walls with the rear wall. This linkage facilitates easier, quicker folding of the box. In addition, after a pizza has been inserted into the box, this linkage between side walls and rear wall can facilitate easier closing of the cover.

To erect the blank of the second embodiment into a box, the following procedure is recommended. First, fold corner flaps 45, 46 inward while folding side walls 41, 42 to upright position. Second, fold outer panel 31 to upright position and fold inner panel 32 downward, thereby erecting the front wall of the box and locking corner flaps 45, 46 into position so that the bottom portion extends through openings 39 in the bottom of the box. Third, erect each of the rear side walls by folding panel 81 to upright position and folding panel 82 downward. Fourth, pull cover 70 forward while folding cover flaps 72, 73, and 74 inward so that they fit inside the box cavity.

CONCLUSION, RAMIFICATIONS, AND SCOPE

I have disclosed a blank and corresponding box that embodies one or more of the following unique structures:

(a) At least six walls including front and rear walls, a pair of forward side walls, and a pair of non-parallel rearward side walls, with the length of the front wall being longer than the length of the rear wall, thereby creating a box of unique appearance and enhanced functionality;

(b) An easy-folding rear diagonal side wall structure comprising a diagonally-disposed rearward side wall and a unitary plurality of hingedly connected connector panels extending between the rearward side wall and a rear wall;

(c) A thermal-leg comprising a corner flap attached to the end of a wall and disposed between the panels of a double-panel wall and projecting through a hole in the bottom of the box, thereby providing for less conductive heat loss and hotter pizza;

(d) A hole-covering double-panel wall structure comprising a flap attached to the bottom edge of an inner panel of a double-panel wall and covering an opening in the bottom of the box, thereby reducing air flow through the opening into a box;

(e) A strengthened double-panel wall comprising inner and outer panels joined by a double-panel connecting structure comprising first and second fold lines and a connector bridge of material between the fold lines, with the first and second fold lines being non-parallel, thereby reducing bowing in the double-panel wall.

The illustrated number, size, shape, type, and placement of components represent the preferred embodiments; however, many other combinations and configurations are possible within the scope of the invention. Examples of some alternate configurations are described below.

In the first embodiment, a particular type of front wall interlock means was utilized. Other types, such as a cover front flap engaged within a slot in a double-panel front wall, could be used instead, as described in my application Ser. No. 08/589,892.

Also in the first embodiment, cover front flap 72 could be eliminated and panel 71 could be extended slightly forward, allowing it to overhang the double-panel front wall.

It's also possible to swap the rearward side wall structures between the two embodiments. In other words, the rearward side wall structure of the first embodiment could be put on the second embodiment and vice versa. Also, the type of cover side flaps used on the first embodiment could be put on the second embodiment and vice versa.

Throughout the discussion, reference has been made to packaging pizza. However, it is noted that my invention can be used for packaging other foods and for other applications, as well.

In conclusion, it is understood that my invention is not to be limited to the disclosed embodiments but, on the contrary, is intended to cover various modifications and equivalent arrangements included within the spirit and scope of the appended claims.

I claim:

1. A blank for a box having at least six sides, said blank being of foldable material cut and scored to define:

(a) a bottom panel having a plurality of edges each having a predetermined length, said plurality of edges including:

(i) opposing front and rear edges, (ii) first and second forward side edges disposed adjacent said front edge, (iii) non-parallel first and second rearward side edges disposed adjacent said first and second forward side edges, respectively;

(b) a plurality of wall structures including a rear wall hingedly attached to said rear edge;

(c) a cover hingedly attached to said rear wall;

wherein the predetermined length of said front edge is noticeably longer than the predetermined length of said rear edge by a predetermined percent;

whereby after said blank has been erected into a box said box has a unique shape and structure.

2. The blank of claim 1 wherein:

each of said first and second forward side edges is disposed at a non-acute angle to said front edge.

3. The blank of claim 1 wherein:

a difference in length exists between the predetermined length of said first forward side edge and the predetermined length of said first rearward side edge, said difference in length is at least ten percent of the predetermined length of either of said first forward side edge and said first rearward side edge.

4. The blank of claim 1 wherein:

said predetermined percent is at least ten percent.

5. The blank of claim 4 wherein:

the predetermined length of said first forward side edge is longer than the predetermined length of said first rearward side edge by at least twenty percent;

said plurality of wall structures further includes:

(a) a front wall structure hingedly attached to said front edge, (b) first and second forward side walls hingedly attached to said first and second forward side edges, respectively.

6. The blank of claim 5 wherein:

said first and second forward side edges are non-parallel.

7. The blank of claim 5 wherein:

said first and second forward side walls are single-panel walls having a top edge free of attachment.

8. The blank of claim 5 wherein:

said front wall structure comprises an outer panel hingedly attached to said front edge and an inner panel hingedly linked to a top edge of said outer panel.

9. The blank of claim 5 wherein:

said cover comprises a cover panel and a front wall interlock means hingedly attached thereto, whereby after said blank is erected into a box said front wall interlock means interlocks with said front wall structure.

10. The blank of claim 5 wherein said plurality of wall structures further includes:

double-panel first and second rearward side wall structures each comprising an outer panel hingedly attached to one of said first and second rearward side edges and an inner panel hingedly linked to said outer panel at a top edge.

11. The blank of claim 10 wherein:

each of said first and second rearward side wall structures further comprises a flap hingedly attached to a rear end of said outer panel.

12. The blank of claim 5 wherein said plurality of wall structures further includes:

first and second rearward side wall structures each comprising a rearward side wall hingedly attached to a rear end of one of said first and second forward side walls.

13. The blank of claim 12 wherein:

each of said first and second rearward side wall structures further comprises a unitary plurality of hingedly connected connector panels hingedly attached to a bottom edge of said rearward side wall and to an end of said rear wall.

14. A paperboard box having at least six sides and comprising:

a bottom panel, a plurality of walls each having a predetermined length, said plurality of walls including:

(a) opposing front and rear walls, (b) first and second forward side walls disposed adjacent said front wall, (c) non-parallel first and second rearward side walls adjacent said first and second forward side walls, respectively;

a cover attached to said rear wall;

wherein the predetermined length of the front wall is noticeably longer than the predetermined length of the rear wall by a predetermined percent.

15. The box of claim 14 wherein:

each of said first and second forward side walls is disposed at a non-acute angle to said front wall.

16. The box of claim 14 wherein:

a difference in length exists between the predetermined length of said first forward side wall and the predetermined length of said first rearward side wall, said difference in length is at least ten percent of the predetermined length of either of said first forward side wall and said first rearward side wall.

17. The box of claim 14 wherein:

said plurality of walls consists of the front wall, rear wall, first and second forward side walls, and first and second rearward side walls.

18. The box of claim 14 wherein:

said predetermined percent is at least ten percent.

19. The box of claim 18 wherein:

the predetermined length of said first forward side wall is longer than the predetermined length of said first rearward side wall by at least twenty percent.

20. A blank for a box having at least one thermal-leg, said blank being of foldable material cut and scored to define:

a bottom panel having adjacent first and second edges and a double-panel interlock opening disposed along said first edge, a plurality of wall structures including:

(a) a double-panel wall structure comprising an outer panel hingedly attached to said first edge and an inner panel hingedly linked to a top edge of said outer panel, said inner and outer panels each having a predetermined height, the predetermined height of the inner panel being substantially the same as the predetermined height of the outer panel, whereby after said blank has been erected into a box said double-panel wall structure forms a double-panel wall comprising inner and outer panels with a portion of a bottom edge of said inner panel being engaged within said double-panel interlock opening;

(b) another wall structure comprising a wall hingedly attached to said second edge and a corner flap hingedly attached to an end of said wall and adjacent said double-panel wall structure, said wall having a wall bottom edge and a bottom edge extension line defined as an imaginary line extending from said wall bottom edge and aligned therewith, said corner flap having a flap bottom edge;

wherein at least a portion of said flap bottom edge extends at least ten millimeters below the bottom edge extension line of said wall, whereby after said blank has been erected into a box said corner flap is disposed between the inner and outer panels of said double-panel wall and a portion of said corner flap projects through said double-panel interlock opening and extends below said bottom panel by at least six millimeters, thereby forming a thermal-leg that helps hold the bottom panel of the box above a support surface, such as a table, by a substantial distance.

21. The blank of claim 20 wherein:

said plurality of wall structures further includes a rear wall hingedly attached to said bottom panel and having a cover hingedly attached thereto, said double-panel wall structure opposes said rear wall, whereby after said blank has been erected into a box the double-panel wall structure forms at least a part of a front wall portion of said box.

22. A box having two thermal-legs, said box being of corrugated paperboard and comprising:

a bottom panel having a plurality of edges including front and rear edges, a plurality of walls including a front wall attached to said front edge, first and second thermal-legs;

wherein:

(a) said first and second thermal-legs each have a bottom edge, at least a portion of said bottom edge extending at least ten millimeters below said bottom panel, (b) said first and second thermal-legs are disposed closer to said front wall than to any other wall of said plurality of walls, (c) said first and second thermal-legs constitute all the thermal-legs on said box.

23. The box of claim 22 wherein:

said bottom panel has first and second double-panel interlock openings disposed along said front edge, said front wall is a double-panel wall structure comprising approximately parallel inner and outer panels, said plurality of walls further includes first and second side walls adjacent said front wall and having respective first and second corner flaps attached to a front end thereof, said first and second corner flaps being disposed between said inner and outer panels and having first and second downward-projecting portions, respectively, extending through said first and second double-panel interlock openings, respectively;

wherein said first and second downward-projecting portions constitute said first and second thermal-legs, respectively.

24. The box of claim 23 wherein:

said plurality of walls further includes a rear wall having a cover hingedly attached thereto.

25. The box of claim 24 wherein:

said box is a hot food carton.

26. A box having a hole-covering double-panel wall structure, said box comprising:

a bottom panel, an opening in said bottom panel, a plurality of wall structures including a rear wall and a double-panel wall structure, said double-panel wall structure comprising:

(a) an outer panel attached to said bottom panel, (b) an inner panel hingedly linked to a top edge of said outer panel and disposed approximately parallel to said outer panel, (c) a hole-covering flap attached to a bottom edge of said inner panel and disposed at an angle to said inner panel;

wherein said hole-covering flap covers at least a portion of said opening, whereby air flow into and out of said box is minimized.

27. The box of claim 26 further comprising:

a thermal-leg disposed adjacent said opening.

28. A paperboard box having at least six sides and comprising:

a bottom panel, a plurality of walls each having a predetermined length, said plurality of walls including:

(a) opposing front and rear walls, (b) non-parallel first and second forward side walls disposed adjacent said front wall, (c) non-parallel first and second rearward side walls adjacent said first and second forward side walls, respectively;

wherein:

the predetermined length of said front wall is at least ten percent longer than the predetermined length of said rear wall, the predetermined length of said first forward side wall is longer than the predetermined length of said first rearward side wall by at least twenty percent.

29. A box having a strengthened double-panel wall, said box comprising:

a bottom panel and a plurality of wall structures including:

(a) a rear wall attached to said bottom panel and having a cover hingedly attached thereto, (b) a double-panel front wall structure comprising approximately parallel inner and outer panels joined by a double-panel connecting structure comprising first and second fold lines and a connector bridge of material between said fold lines, (c) opposing first and second side walls attached to said bottom panel and disposed adjacent said double-panel front wall structure;

wherein said first and second fold lines are non-parallel and, thereby, said connector bridge of material is wider at a first spot than at a second spot and said first spot is a middle portion of said connector bridge of material and said second spot is an end portion of said connector bridge of material.

30. The box of claim 29, wherein:

said cover comprises a cover panel, first and second side flaps attached to first and second side edges of said cover panel, and first and second front wall interlock flaps attached to a front end of said first and second side flaps, respectively.

* * * * *